US012806503B2

(12) United States Patent
Salvino et al.

(10) Patent No.: US 12,806,503 B2
(45) Date of Patent: Nov. 24, 2026

(54) SPORTS PADDLE INCLUDING SCOREKEEPING DEVICE

(71) Applicants: Tracy Salvino, Western Springs, IL (US); Kari Gough, Western Springs, IL (US)

(72) Inventors: Tracy Salvino, Western Springs, IL (US); Kari Gough, Western Springs, IL (US)

( * ) Notice: Subject to any disclaimer, the term of this patent is extended or adjusted under 35 U.S.C. 154(b) by 642 days.

(21) Appl. No.: 18/328,090

(22) Filed: Jun. 2, 2023

(65) Prior Publication Data

US 2024/0299831 A1 Sep. 12, 2024

Related U.S. Application Data

(60) Provisional application No. 63/489,327, filed on Mar. 9, 2023.

(51) Int. Cl.

| | |
|---|---|
| ***A63B 71/06*** | (2006.01) |
| ***A63B 59/42*** | (2015.01) |
| ***A63B 60/16*** | (2015.01) |

(52) U.S. Cl.
CPC ..... *A63B 71/0672* (2013.01); *A63B 59/42* (2015.10); *A63B 60/16* (2015.10)

(58) Field of Classification Search
CPC ..... A63B 71/0672; A63B 60/16
See application file for complete search history.

(56) References Cited

U.S. PATENT DOCUMENTS

| | | | | |
|---|---|---|---|---|
| 3,730,131 A * | 5/1973 | Izzo | A63B 71/0672 235/114 |
| 6,012,995 A * | 1/2000 | Martin | A63B 71/0669 377/5 |
| 2021/0252356 A1* | 8/2021 | Thurman | A63B 59/42 |
| 2021/0283469 A1* | 9/2021 | Nelson | A63B 60/16 |

* cited by examiner

*Primary Examiner* — Brian P Wolcott
(74) *Attorney, Agent, or Firm* — Armstrong Teasdale LLP

(57) ABSTRACT

A paddle for use in a racket sports game includes a head, a handle extending from the head between a distal handle end proximate the head and an opposite proximal handle end, and a scorekeeping device installed in the paddle adjacent to the proximal handle end.

19 Claims, 7 Drawing Sheets

SPORTS PADDLE INCLUDING SCOREKEEPING DEVICE

CROSS-REFERENCE TO RELATED APPLICATION

This application claims priority to U.S. Provisional Patent Application No. 63/489,327, filed Mar. 9, 2023, the disclosure of which is hereby incorporated by reference herein in its entirety.

BACKGROUND

The field of the disclosure relates generally to racket sports, and more specifically, to rackets or paddles including a device for scorekeeping during a sports game.

Racket sports are played using a racket or paddle to strike a ball or other object. There are many different types of racket sports. Example racket sports include tennis, table tennis, pickleball, badminton, squash, racquetball, among others. Generally, racket sports are played by two teams of one or more players. The teams alternate in striking the ball or object using the racket or paddle towards the other team. The goal is to strike the ball or object within the rules prescribed by the particular game and in such a way that the opposing team's subsequent strike violates the rules of the game or otherwise results in an invalid or illegal return of the ball or object. Depending on the particular game played, when a team's strike violates the rules of the game or results in an invalid or illegal return, the other team may either be awarded a point or advances the game towards having the opportunity to win a point. The game continues until one team has reached the necessary number of points needed to win the game.

Pickleball is one of the fastest growing racket sports. It is played within a defined playing area or "court," by two opposing teams. Each team may include a single player (in a "singles" game) or two players (in a "doubles" game). Each team plays on a respective side of the court, the two sides being divided by a netted barrier. Each player is equipped with a paddle. During a turn of a pickleball game, the teams alternate in striking a pickleball ball until one team wins the turn. A turn of a pickleball game is initiated by one teaming serving the ball. Only the serving team is awarded a point upon winning the rally. In a singles game, once the non-serving team wins a rally, the non-serving team becomes the serving team for the next turn and has the opportunity to win a point. In a doubles game, both players of the serving team have the chance to serve before the serving team relinquishes the opportunity to win a point to the non-serving team.

One difficult or burdensome aspect of pickleball is keeping score. The scorekeeping rules of pickleball alone may be a difficult concept for players to grasp, particularly in doubles games. This may lead to opposing teams arriving at different scores and result in disagreement as to the actual score. The task of scorekeeping may be made more difficult during exhibition or friendly games where the players are required to mentally keep score during the game. These difficulties are not limited to pickleball, and extend across many racket sports. Thus, a need exists for providing racket sports players with a readily available scorekeeping device that facilitates overcoming these disadvantages.

BRIEF DESCRIPTION

In one aspect, a paddle for use in a racket sports game is provided. The paddle includes a head, a handle extending from the head between a distal handle end proximate the head and an opposite proximal handle end, and a scorekeeping device installed in the paddle adjacent to the proximal handle end.

In another aspect, a paddle for use in a pickleball game is provided. The paddle includes a head, faceplates attached to the head, the faceplates defining opposing surfaces of the head for striking a pickleball ball, a handle extending from the head between a distal handle end proximate the head and an opposite proximal handle end, and a scorekeeping device installed in the paddle adjacent to the proximal handle end.

In another aspect, a scorekeeping assembly for a sports paddle that includes a handle is provided. The scorekeeping assembly includes a scorekeeping device for presenting scorekeeping information to a user, and a butt cap connectable with an end of the handle, the butt cap including a housing portion that houses the scorekeeping device.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference numerals used throughout the drawings indicate corresponding parts.

DETAILED DESCRIPTION

Examples are described with respect to a paddle for use by a player of a pickleball game but may be applicable to rackets or paddles for use in other racket sports. For example, features and elements (e.g., a scorekeeping device) of example pickleball paddles described herein may be implemented in rackets or paddles used in tennis, table tennis, squash, badminton, racquetball, and other racket sports. A handle of the paddle or racket includes a scorekeeping device installed therein. The scorekeeping device enables a player to track the score of a game while participating in the game. The scorekeeping device thereby facilitates reducing disagreements between players of the game as to the score and providing accurate scorekeeping. Furthermore, the scorekeeping device may be particularly suited for the sport associated with the paddle or racket in which the scorekeeping device is installed. The scorekeeping device installed in the pickleball paddle may include a mechanical set of dials, each dial containing an array of chronologically-arranged numbers and being designated for a particular scorekeeping task (e.g., points of a first team during an individual game, points of a second team during an individual game, number of games won by the first team, number of games won by the second team, etc.). The highest number on the dials designated for tracking the points of the teams during an individual game may be indicative of the number of points required to win the game in the particular sport associated with the racket or paddle in which in the scorekeeping device is installed. Thereby, the scorekeeping device may facilitate teaching a player the scorekeeping rules of the sport and reducing the chance that a game will be erroneously scored.

Figure 1:
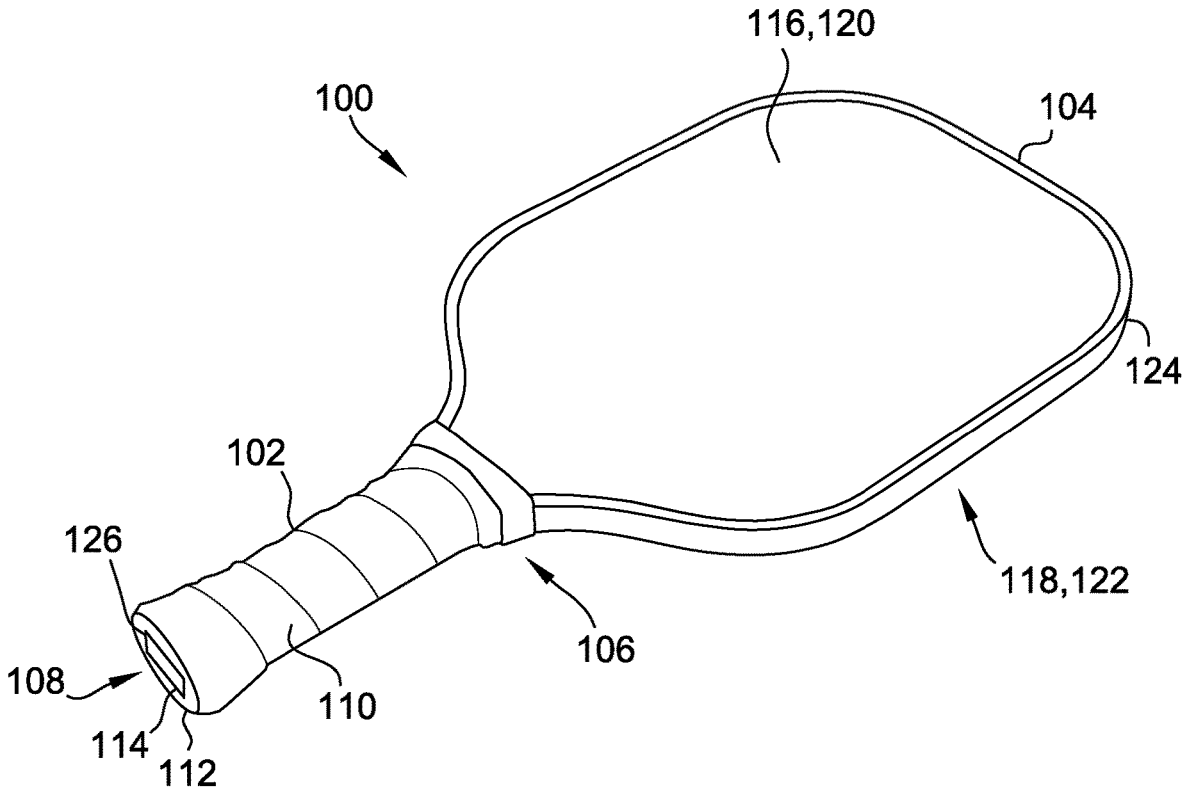
FIG. 1 is a perspective view of an example paddle for a racket sport.

FIG. 1 is a perspective view of an example racket or paddle 100 for use by a player of a racket sport. In the example embodiment, the paddle 100 is suitable for use by a player of the sport of pickleball. The features and elements of the paddle 100 described herein may be implemented in any other suitable racket or paddle used in other racket sports, such as, for example, rackets or paddles used by players of tennis, table tennis, squash, badminton, racquetball, and other racket sports.

The paddle 100 includes a handle 102 and a head 104. The handle 102 may be made integral with the head 104 to form a one-piece frame, or the handle 102 may be separate from and attached to the head 104 (e.g., by adhesive bonding, thermal bonding, mechanical fasteners, or other suitable means). Where the handle 102 is attached to the head 104, the handle 102 may be separated from the head 104 by one or more intermediate components. The handle 102 and the head 104 may be formed from any suitable material to enable the paddle 100 to be used by the pickleball player. The handle 102 and the head 104 may be formed from the same material or a different material. Non-limiting example materials for the handle 102 and/or the head 104 may include fiber composite materials, such as a carbon-fiber composite material or fiber reinforced plastics (e.g., fiberglass), other composite materials, graphite, aluminum, other metallic alloys, wood (e.g., balsa), a polyurethane foam, other polymeric foams, other lightweight elastic foams, a thermoplastic material, a thermoset material, and combinations thereof.

The head 104 includes two opposing, substantially parallel surfaces 116, 118 for striking a pickleball ball. The surfaces 116, 118 may be defined by faceplates 120, 122 extending on opposing sides of an inner layer of the head 104. The faceplates 120, 122 may be attached to the inner layer of the head 104 using any suitable means (e.g., by adhesive bonding, thermal bonding, mechanical fasteners). In some examples, the faceplates 120, 122 are not included and the head 104 includes a single layer that defines the surfaces 116, 118. The faceplates 120, 122 may include panels or plates that extend substantially parallel to one another. The faceplates 120, 122 may be opaque or one or both of the faceplates 120, 122 may be formed from a translucent or semi-translucent material. The faceplates 120, 122 may be similar to one another in composition and stiffness, or the faceplates may be different in chemical composition, thickness and/or stiffness characteristics. For example, the faceplates 120, 122 may be formed from the same material, or the faceplates 120, 122 may be formed from different materials having different material properties. Materials described above that are suitable for the head 104 are applicable as suitable materials for one or both of the faceplates 120, 122.

The head 104 also include an edge strip or bumper 124 that surrounds the surfaces 116, 118. The bumper 124 includes a strip of material covering a peripheral edge of the head 104. The bumper 124 may be opaque, translucent, or semi-translucent. The bumper 124 may be formed from a thin strip of a polymeric film or tape adhesively bonded to the peripheral edge of the head 104. The bumper 124 may additionally and/or alternatively be a layer that is coated about the peripheral edge of head 104. Examples of suitable materials from which bumper 124 may be formed include those described above for the head 104. In some examples, the paddle 100 may be formed without a bumper.

The handle 102 extends from the head 104 and is configured for being gripped by a player's hand or hands. The handle 102 has an elongate tubular structure, and may have a polygonal cross-sectional shape, a circular cross-sectional shape, an oval cross-sectional shape, or any other suitable cross-sectional shape. The handle 102 extends between a distal handle end 106 that is proximate the head 104 and an opposite proximal handle end 108. The distal handle end 106 may be connected to the head 104 (and, optionally, separated from the head 104 by one or more components), or may be made integral with the head 104.

The handle 102 may include a grip 110 to enhance the ability of a player to grasp, hold and use the paddle 100 to strike a ball and/or to otherwise provide comfort to the player when using the paddle 100. The grip 110 may be attached (e.g., as an adhesive tape) to the handle 102 or may be made integral with the handle 102. The grip 110 may include any suitable material such as, for example, rubber, leather, or a synthetic polymer material (e.g., nylon or neoprene). The grip 110 may also include features that provide additional comfort and/or enhance the function of the grip 110, such as perforations for example.

The paddle 100 also includes a butt cap 112 disposed adjacent to the proximal handle end 108. The butt cap 112 may be adhesively bonded, thermally bonded, mechanically fastened, or otherwise directly attached to the proximal handle end 108. In some examples, the butt cap 112 may be made integral with the handle 102 at the proximal handle end 108.

The paddle 100 also includes a scorekeeping device 126 (shown schematically in FIG. 1) disposed at the proximal handle end 108 and accessible by the player via an opening 114 defined in the butt cap 112. The scorekeeping device 126 may be installed in the butt cap 112 or may be installed in the handle 102 adjacent to the proximal handle end 108. The location of the scorekeeping device 126 on the paddle 100 is not limited to the examples shown and described. The scorekeeping device 126 may be installed in the paddle 100 at any suitable location. For example, the scorekeeping device 126 may be located near or adjacent to the distal handle end 106, on the head 104, or the scorekeeping device 126 may be installed as a component of the paddle 100 between the distal handle end 106 and the head 104. In the examples shown, the scorekeeping device 126 is suitably installed at or near the proximal handle end 108 (e.g., installed in the handle 102 at the proximal handle end 108 and/or in the butt cap 112) to facilitate reducing the likelihood that the scorekeeping device 126 will be damaged when the player strikes a ball using the paddle 100.

In some examples, the scorekeeping device 126 may be removably installed in the paddle 100. Reference made herein to the scorekeeping device 126 being "installed" in the paddle 100 refers to examples where the scorekeeping device 126 is mechanically installed in the handle 102 and/or the butt cap 112 and to examples where the scorekeeping device 126 is removably connected to, and selectively detachable from, the handle 102 and/or the butt cap 112. For example, the scorekeeping device 126 may be removably attached to the proximal handle end 108 such that the scorekeeping device 126 may be selectively installed in and removed from the handle 102.

Figure 6:
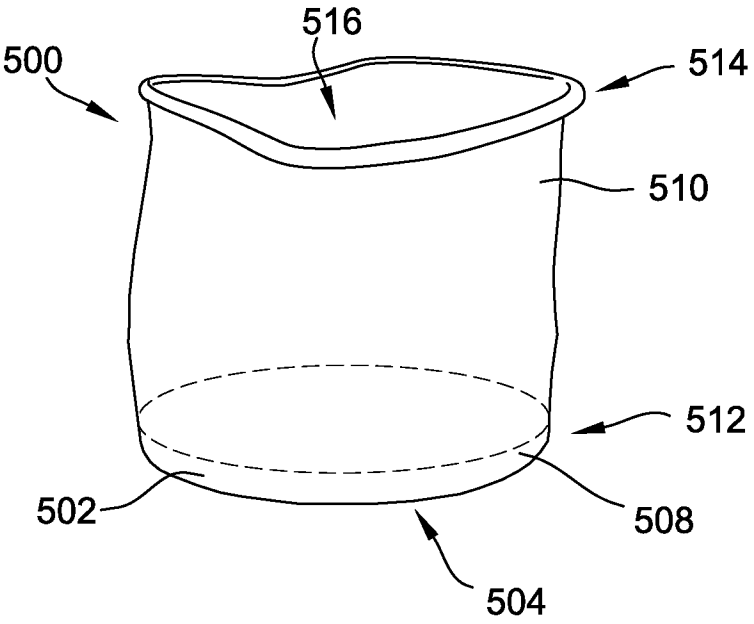
FIG. 6 is a side view of the example butt cap shown in FIG. 5.
Figure 5:
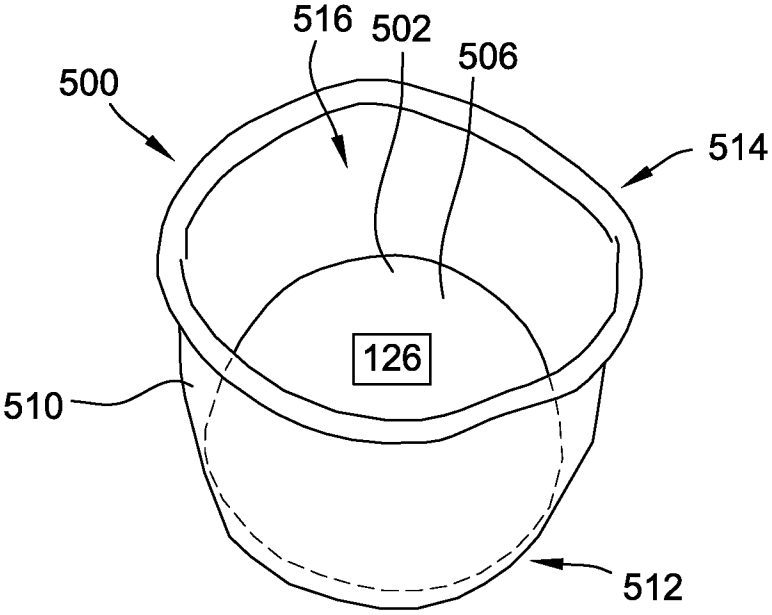
FIG. 5 is a perspective view of an example butt cap that enables selective installation of the scorekeeping device in the paddle shown in FIG. 1.

FIGS. 5 and 6 depict an example butt cap 500 that houses the scorekeeping device 126 (shown schematically in FIG. 5) and is suitably implemented as the butt cap 112. The elements and features described herein for the butt cap 112 are applicable to the butt cap 500. The butt cap 500 is connectable with the proximal handle end 108 to enable the scorekeeping device 126 to be selectively installed in the paddle 100. The butt cap 500 may also be removably connectable with the proximal handle end 108 to enable the scorekeeping device 126 to be removed from the paddle 100 after installation and use thereof. The butt cap 500 includes a housing portion 502 that includes the scorekeeping device 126 and defines the opening 114 (shown in FIG. 1) on a first major face 504 of the housing portion 502. The housing portion 502 also includes a second major face 506 and a peripheral edge 508 that joins the faces 504 and 506. The housing portion 502 is suitably sized and shaped to complement a size and shape of the handle 102 at the proximal handle end 108 and to otherwise minimize bulk of the butt cap 500 and the scorekeeping device 126 when installed in the paddle 100.

The butt cap 500 also includes a sleeve 510 attached to the housing portion 502 (e.g., at one or both of the major faces 504, 506 and/or at the peripheral edge 508). The sleeve 510 may adhesively bonded, thermally bonded, mechanically fastened, or otherwise directly attached to the housing portion 502. The sleeve 510 extends between a first sleeve end 512 that is attached to the housing portion 502 and a second sleeve end 514 that is located outwardly from the major face 506 of the housing portion 502 opposite the major face 504. An opening 516 is defined at the second sleeve end 514 that receives the proximal handle end 108 of the handle 102 of the paddle 100. The sleeve 510 surrounds and fits onto the handle 102 to removably install the butt cap 500 in the paddle 100. When the butt cap 500 is installed in the paddle 100, the major face 506 faces and may be in contact with the proximal handle end 108. The sleeve 510 may suitably extend a length less than or equal to a length of the handle 102. The sleeve 510 is suitably sized, shaped, and formed of a material such that the sleeve 510 and the handle 102 form a friction fit therebetween to enable removable installation of the butt cap 500 in the paddle 100. Suitable, non-limiting example materials for the sleeve include rubber, leather, or plastic or another synthetic polymer material (e.g., nylon or neoprene), or any combination of two or more of these materials. In some examples, the sleeve 510 may also form the grip 110 (shown in FIG. 1). In some examples, the sleeve 510 enables removable installation of the butt cap 500 in the paddle 100 without any additional fastening means (e.g., without the use of adhesives).

In some examples, the sleeve 510 may be omitted from the butt cap 500. The butt cap 500 may be connected with the proximal handle end 108 using any suitable means. For example, the butt cap 500 may include an adhesive layer (not shown) that at least partially covers and/or is disposed on one of the faces 504 and 506 of the housing portion 502 of the butt cap 500. The adhesive layer may connect the butt cap 500 with the proximal handle end 108 to install the butt cap 500 in the paddle 100. The adhesive layer may enable the butt cap 500 to be permanently or removably connected with the proximal handle end 108. Other suitable means for permanently and/or removably connecting the butt cap 500 with the proximal handle end 108 include mechanical fasteners, tape, bonding, and the like.

Figure 2:
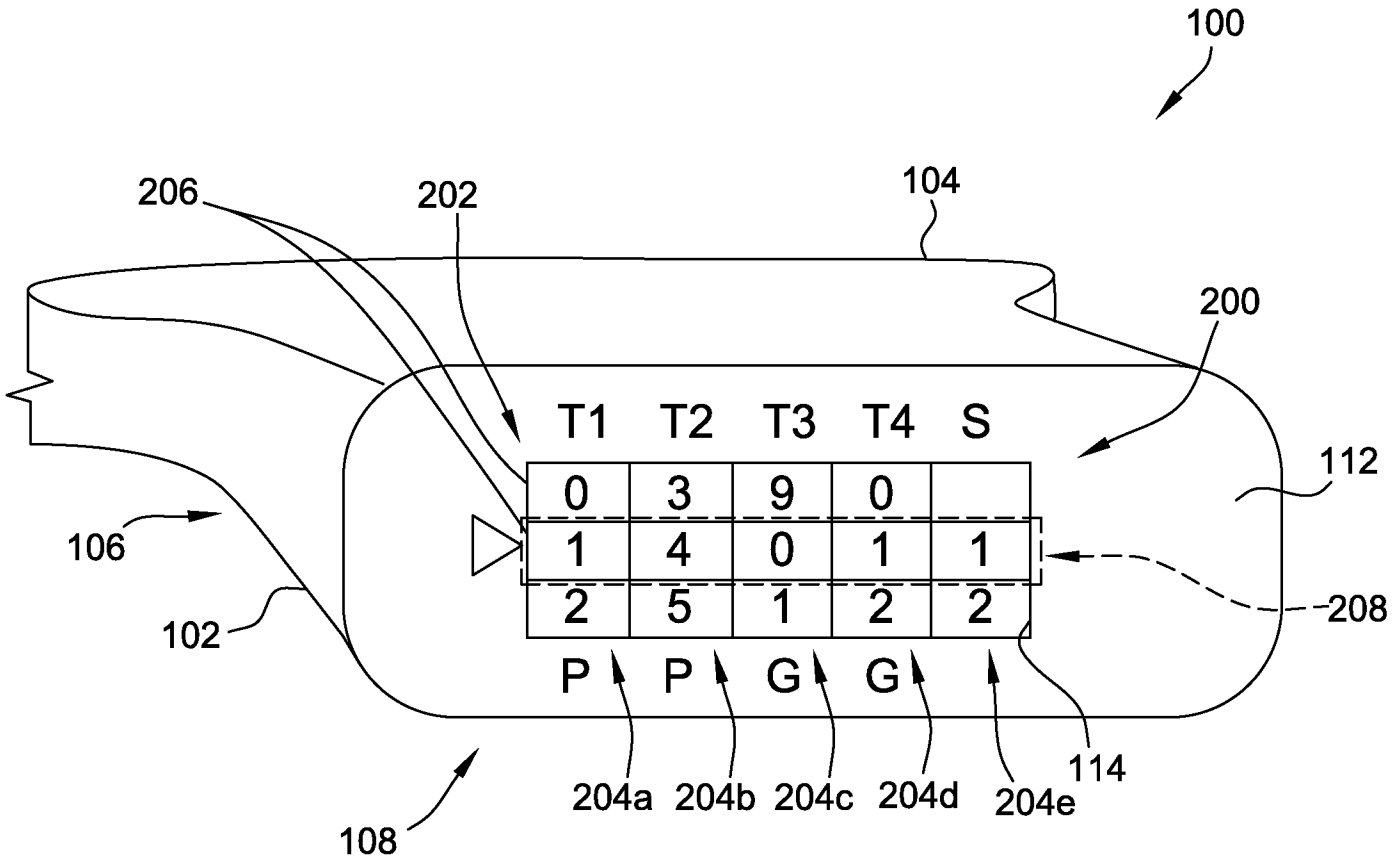
FIG. 2 is a bottom view of the paddle shown in FIG. 1 showing one embodiment of a scorekeeping device installed in the paddle.

Referring now to FIG. 2, a bottom view of the paddle 100 is shown to depict the proximal handle end 108, the butt cap 112, and an example scorekeeping device 200 in greater detail. The example scorekeeping device 200 may suitably be implemented as the scorekeeping device 126 (shown in FIG. 1). The example scorekeeping device 200 includes a set of mechanical dials 202 that each contain an array of numbers and are each rotatable to enable a player to manipulate the set of dials 202 for a scorekeeping operation. In the example scorekeeping device 200, the set 202 includes five dials: a first dial 204*a*, a second dial 204*b*, a third dial 204*c*, a fourth dial 204*d*, and a fifth dial 204*e*. In other examples, the set 202 may include more or fewer dials. For example, the number of dials included in the set 202 may range from two dials to four dials, or the set 202 may include more than five dials.

Each of the dials of the set 202 (e.g., each of the dials 204*a*-204*e*) has a generally annular structure with teeth 206 formed along the outer peripheral edge of the dial. Each of the teeth 206 of the dials 204*a*-204*e* bears one of the array of numbers. The number of teeth 206 formed in each of the dials 204*a*-204*e* may be determined by the numbers included in the array of numbers. As described in more detail below, the numbers included in the array for each dial 204*a*-204*e* may be the same or different and, thus, the number of teeth 206 formed in each dial 204*a*-204*e* may be the same or different. In some examples, the number of teeth 206 formed in each dial 204*a*-204*e* may be the same for each of the dials 204*a*-204*e*, and, for some of the dials 204*a*-204*e*, some of the teeth 206 may not bear a number. The teeth 206 may enable a player to manipulate the dial 204*a*-204*e*. For example, the dials 204*a*-204*e* may be rotatably positioned on a shaft (not shown) installed within the handle 102 and/or in the butt cap 112, and a player may cause rotation of one of the dials 204*a*-204*e* about the shaft using the teeth 206. The dials 204*a*-204*e* are suitably independently rotatable relative to one another, such that a player may selectively manipulate one of the dials 204*a*-204*e*.

The opening 114 of the butt cap 112 defines a viewable matrix for the dials 204*a*-204*e*, and the player is enabled to access and manipulate the dials 204*a*-204*e* via the opening 114. In the example shown in FIG. 2, the opening 114 is sized and shaped to define a 3×5 viewable matrix for the dials 204*a*-204*e*, i.e., three of the numbers contained on each dial 204*a*-204*e* are viewable via the opening 114 and three of the teeth 206 of each dial 204*a*-204*e* are accessible by the player to selectively manipulate the dials 204*a*-204*e*. The viewable matrix defined by the opening 114 thereby enables the player to track a score of a pickleball game using the scorekeeping device 200, as described further below.

Each of the dials 204*a*-204*e* may be designated for a particular scorekeeping function. In the example scorekeeping device 200, the first dial 204*a* and the second dial 204*b* are designated for tracking the points scored by one of the teams during a pickleball game ("Team 1"). The first dial 204*a* and the second dial 204*b* cooperate to present the score of Team 1. The third dial 204*c* and the fourth dial 204*d* are designated for tracking the points scored by the other one of the teams during the pickleball game ("Team 2"). The third dial 204*c* and the fourth dial 204*d* cooperate to present the score of Team 2. The fifth dial 204*e* is designated for tracking the server number of the serving team (which may only be necessary during a doubles game). In the example shown in FIG. 2, the dials 204*a*-204*e* are arranged in order from left to right. In other examples, the dials 204*a*-204*e* may be arranged in any suitable order.

The butt cap 112 may include insignia that indicate the scorekeeping functions of each dial 204*a*-204*e* and/or identify which row of the viewable matrix defined by the opening 114 is designated as the scorekeeping row. The insignia are suitably located adjacent to the opening 114 at appropriate positions relative to viewable portions of the dials 204*a*-204*e* to provide the intended indication. In the example shown in FIG. 2, the butt cap 112 includes the insignia "T1" and "T2" above viewable portions of the dials 204*a*, 204*b* and 204*c*, 204*d*, respectively, to indicate whether the dials 204*a*-204*d* are designated for Team 1 or Team 2. The butt cap 112 also includes the insignia "S" above the viewable portion of the dial 204*e* to indicate that the dial 204*e* is designated to track the server number of the current serving team. The butt cap 112 also includes an arrow insignia to the left of the opening 114 and the viewable matrix. The arrow insignia identifies which row of the viewable matrix defined by the opening 114 is designated as a scorekeeping row 208, that is, the row in which the appropriate number of each dial 204*a*-204*e* should be landed (i.e., by the player selectively manipulating the dials 204*a*-204*e*) to represent the correct overall score. The dials 204*a*-204*e* may also be color coordinated based on the scorekeeping task. For example, the dials designated a scorekeeping function associated with Team 1 (e.g., dials 204*a* and 204*b* in the example shown) may have a blue color, and the dials designated a scorekeeping function associated with Team 2 (e.g., dials 204*c* and 204*d* in the example shown) may have a red color. The dials 204*a* and 204*b* may have any suitable first color and the dials 204*c* and 204*d* may have any suitable second color that is different from the first color. The dial designated to track the server number (e.g., dial 204*e* in the example shown) may have any suitable third color that is different from the first and second color.

In some examples, the first dial 204*a* and the second dial 204*b* may be designated for different scoring tasks for Team 1, and the third dial 204*c* and the fourth dial 204*d* may be designated for different scoring tasks for Team 2. For example, the first dial 204*a* may be designated for tracking the points scored by Team 1 while the second dial 204*b* is designated for tracking the number of games won by Team 1. Additionally and/or alternatively, the third dial 204*c* may be designated for tracking the points scored by Team 2 while the fourth dial 204*d* is designated for tracking the number of games won by Team 2. As described above, the fifth dial 204*e* is designated for tracking the server number of the serving team. In these examples, the dials 204*a*-204*e* may be arranged in any suitable order. For example, the dials 204*a* and 204*c* for tracking the number of points scored by Team 1 and Team 2, respectively, may be positioned adjacent to each other, and the dials 204*b* and 204*d* for tracking the number of games won by Team 1 and Team 2, respectively, may be positioned adjacent to each other. In these examples, in addition to the insignia described above, the butt cap 112 may also include the insignia "P" below the viewable portions of dials 204*a*, 204*c* to indicate that the dials 204*a*, 204*c* are designated to track the points scored by Team 1 and Team 2, respectively. Similarly, the butt cap 112 may include the insignia "G" below the viewable portions of dials 204*b*, 204*d* to indicate that the dials 204*c*, 204*d* are designated to track the points scored by Team 1 and Team 2, respectively. These insignia may be similar to those illustrated in FIG. 4 and described below.

Each dial 204*a*-204*e* contains an array of numbers of a suitable length that may be based on the scorekeeping function of the respective dial. For example, the first dial 204*a* may contain an array of numbers from 0-2, and the second dial 204*b* may contain an array of numbers from 0-9. The adjacent first and second dials 204*a*, 204*b* may thereby cooperate to present scores of Team 1 between 00 to 29. In some examples, the dials 204*a* and 204*b* may contain arrays of numbers of any suitable length. For example, both of the first and second dials 204*a*, 204*b* may contain an array of numbers from 0-9, such that the dials 204*a*, 204*b* may cooperate to present scores of Team 1 between 00 to 99. The third dial 204*c* may contain an array of numbers from 0-2, and the fourth dial 204*d* may contain an array of numbers from 0-9. The adjacent third and fourth dials 204*c*, 204*d* may thereby cooperate to present scores of Team 2 between 00 to 29. In some examples, the dials 204*c* and 204*d* may contain arrays of numbers of any suitable length. For example, both of the third and fourth dials 204*c*, 204*d* may contain an array of numbers from 0-9, such that the dials 204*c*, 204*d* may cooperate to present scores of Team 2 between 00 to 99. The dial 204*e* may contain an array of numbers from 1-2, which represents that the serving team only has two available servers. As the dials 204*a*-204*e* may contain arrays of numbers of different lengths, the dials 204*a*-204*e* may either be formed with a different number of teeth 206 that each bear a number, or some of the teeth 206 of some of the dials 204*a*-204*e* may not bear a number. In some examples, to facilitate ease of construction and assembly of the paddle, each of the dials 204*a*-204*e* may include the same array of numbers on the same number of teeth 206. Suitably, for each of the dials 204*a*-204*e*, the array of numbers is chronologically aligned to facilitate easier manipulation of the dial 204*a*-204*e* to land the intended number in the scorekeeping row 208 (i.e., the row of the viewable matrix identified by the arrow insignia described above and shown in FIG. 2). In some examples, the length of the array of numbers for each dial 204*a*-204*e* may be determined based on the rules of pickleball (or the rules of another racket sport that the paddle 100 is suitably used for).

In operation of the paddle 100, and at the beginning of a pickleball game, the dials 204*a*-204*d* may be manipulated (e.g., reset from a previous game) such that the scorekeeping row 208 shows 00-00 in the first four columns. If the game being played is a doubles game, the dial 204*e* is set to indicate in the last column of the scorekeeping row 208 the server number of the serving team (typically, this begins at 2 because only one player of the initial serving team of a pickleball game has the opportunity to serve before the other team becomes the serving team upon winning a rally). As the game is played and points are awarded to Team 1 and/or Team 2, the dials 204*a*-204*e* are selectively manipulated by the player (e.g., by engaging the teeth 206 with a finger or thumb of the player and selectively rotating the appropriate dials 204*a*-204*e*) to land the appropriate number of each of the dials 204*a*-204*e* in the scorekeeping row 208 and enable the player to keep track of the score. In some examples, each of the players may include a paddle 100 that includes the scorekeeping device 200, and each player keeps track of the score using their respective paddle 100. FIG. 2 shows an example pickleball score in which Team 1 has 14 points (as cooperatively presented by the first and second dials 204*a*, 204*b*), Team 2 has 10 points (as cooperatively presented by the third and fourth dials 204*c*, 204*d*), and the server number on the serving team is 1 (as presented by the fifth dial 204*e*).

Figure 3:
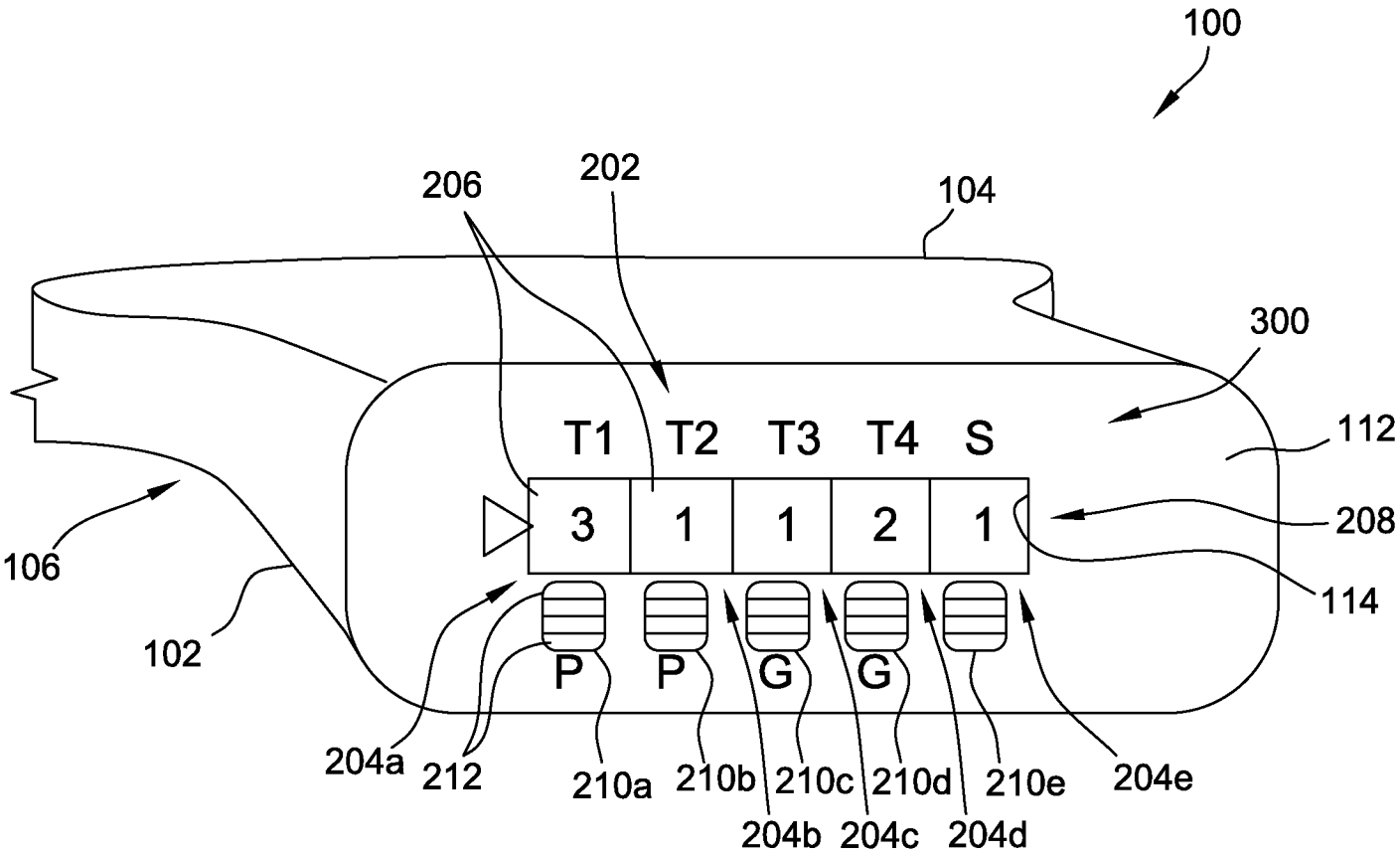
FIG. 3 is a bottom view of the paddle shown in FIG. 1 showing a first alternative embodiment of a scorekeeping device installed in the paddle.

Referring now to FIG. 3, a bottom view of the paddle 100 is shown to depict the proximal handle end 108, the butt cap 112, and another example scorekeeping device 300 in greater detail. The example scorekeeping device 300 includes the same elements and features as the scorekeeping device 200 described above and shown in FIG. 2, and corresponding reference numbers are used to indicate corresponding features and elements. Like the scorekeeping device 200, the example scorekeeping device 300 may suitably be implemented as the scorekeeping device 126 (shown in FIG. 1). The scorekeeping device 300 includes the set 202 of dials 204*a*-204*e* as described above. The butt cap 112 includes the insignia as described above. In the example shown in FIG. 3, the opening 114 of the butt cap 112 is sized and shaped to define a 1×5 viewable matrix of the dials 204*a*-204*e*, i.e., one of the numbers contained on each dial 204*a*-204*e* are viewable via the opening 114 and one of the teeth 206 of each dial 204*a*-204*e* are accessible by the player to selectively manipulate the dials 204*a*-204*e*. The 1×5 matrix defined by the opening forms the scorekeeping row 208. Because only one of the teeth 206 of each dial 204*a*-204*e* are accessible via the opening 114, a player may have some difficulty manipulating the dials 204*a*-204*e* for scorekeeping. The scorekeeping device 300 also includes gears 210*a*-210*e* to enable the player to manipulate the dials 204*a*-204*e*. The gears 210*a*-210*e* each include gear teeth 212 that engage the teeth 206 of the respective dials 204*a*-204*e*. The gears 210*a*-210*e* are rotatable and rotation of the gears 210*a*-210*e* translates to rotation of the dials 204*a*-204*e*. Thus, a player may rotate the gears 210*a*-210*e*, thereby manipulating the dials 204*a*-204*e*, to land the suitable number of each of the dials 204*a*-204*e* in the scorekeeping row 208. In the example shown in FIG. 3, the dials 204*a*-204*e* have been manipulated to indicate a pickleball score in which Team 1 has nine points (as cooperatively presented by the first and second dials 204*a*, 204*b*), Team 2 has twelve points (as cooperatively presented by the third and fourth dials 204*c*, 204*d*), and the server number on the serving team is 1 (as presented by the fifth dial 204*e*).

Figure 4:
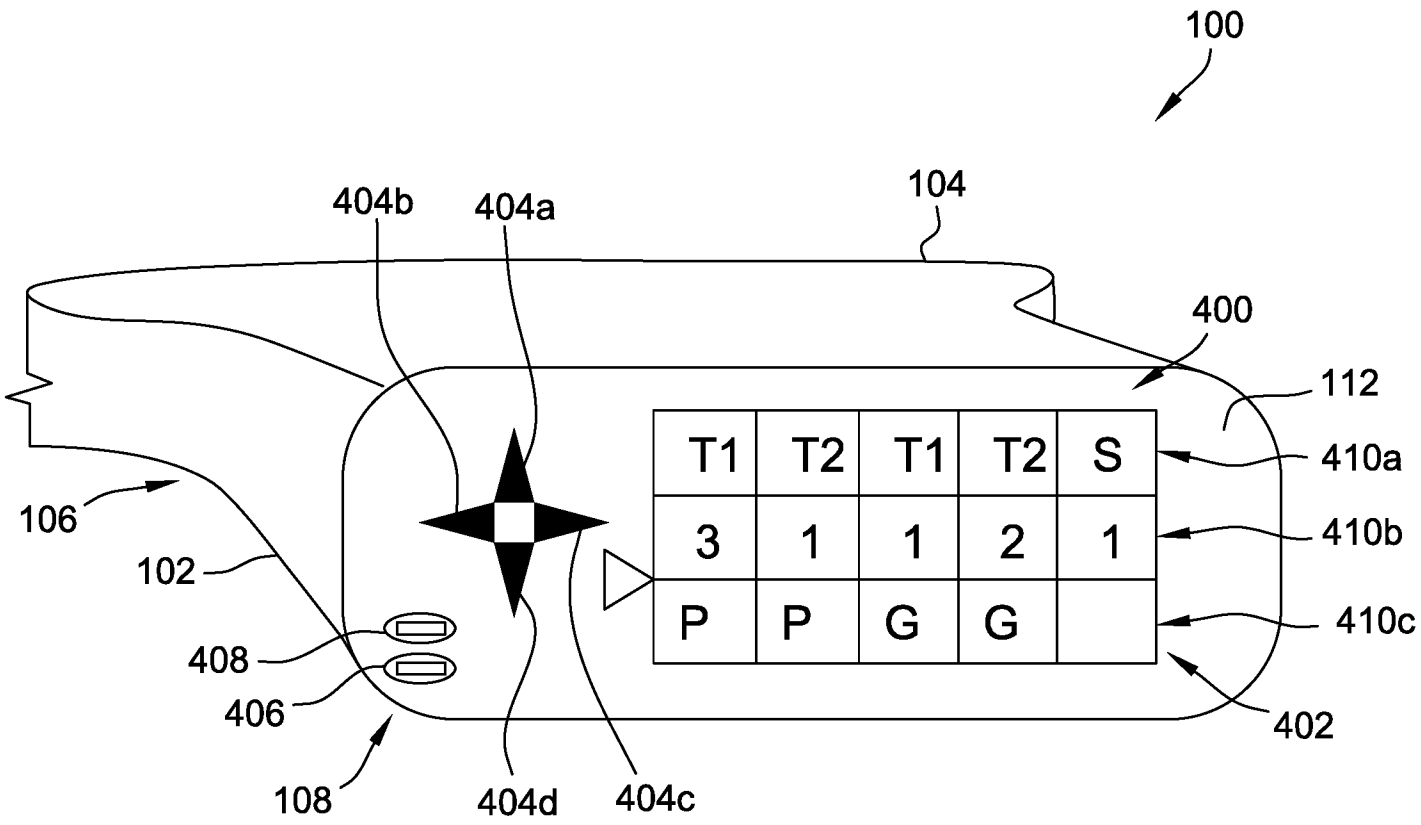
FIG. 4 is bottom view of the paddle shown in FIG. 1 showing a second alternative embodiment of a scorekeeping device installed in the paddle.

Referring now to FIG. 4, a bottom view of the paddle 100 is shown to depict the proximal handle end 108, the butt cap 112, and another example scorekeeping device 400 in greater detail. Like the scorekeeping devices 200 and 300 described above, the example scorekeeping device 400 may suitably be implemented as the scorekeeping device 126 (shown in FIG. 1). Unlike the scorekeeping devices 200 and 300, which include the set 202 of mechanical dials 204*a*-204*e*, the scorekeeping device 400 is electronically powered via a power source (not shown), such as a rechargeable battery.

The scorekeeping device 400 includes a display 402 and a set of keys 404*a*-404*d*. The display 402 and the keys 404*a*-404*d* are part of a housing of the scorekeeping device 400 (not shown) that is installed in the handle 102 and/or in the butt cap 112. The display 402 and the keys 404*a*-404*d* are viewable and/or accessible via openings in the butt cap 112 that are sized and shaped to accommodate the display 402 and the keys 404*a*-404*d*. The display 402 and/or the keys 404*a*-404*d* may be sealed to the butt cap 112 using one or more gaskets to limit or prevent moisture from entering into the housing of the scorekeeping device 400. The butt cap 112 may also include a selectively sealable opening to enable access to a charging port 406 (e.g., a USB port) of the housing of the scorekeeping device 400 to enable re-charging of the battery of the scorekeeping device 400. The battery may be electrically coupled to a charging circuit (not shown) and to a microprocessor (not shown) of the scorekeeping device 400. A power switch 408 (e.g., a slide-switch), which may be accessible via the same or another selectively sealable opening in the butt cap 112, may enable a player to selectively engage and disengage power from the battery to the microprocessor to thereby power on and power off the scorekeeping device 400. In some examples, the charging port 406 and/or the power switch 408 may be located on the handle 102 or another suitable location on the paddle 100.

The scorekeeping device 400 includes the microprocessor that controls the display 402 to graphically present information related to a pickleball score. In the example shown in FIG. 4, the display is controlled to display information similar to the scorekeeping devices 200 and 300. In this example, the display presents a 3×5 matrix and includes three rows 410*a*-410*c* and five columns. The five columns are each designated a different scorekeeping task. In particular, in order from left to right, the first column is designated for tracking the points scored by Team 1, the second column is designated for tracking the number of games won by Team 1, the third column is designated for tracking the points scored by Team 2, fourth column is designated for tracking the number of games won by Team 2, and the fifth column is designated for tracking the server number of the serving team. The first (top) row 410*a* presents indicia information similar to that described above with respect to the scorekeeping devices 200 and 300. The third (bottom) row 410*c* additionally includes "P" and "G" insignia to indicate whether a column is presenting points scored by the team indicated by insignia in the column and the top row 410*a* and or the number of games won by the team indicated by insignia in the column and the top row 410*a*. The middle row 410*b* includes the score information and represents the adjustable scorekeeping row 410*b*.

The keys 404*a*-404*d* are operably connected to the microprocessor and enable the player to enter inputs and adjust the information presented on the display 402. In the example scorekeeping device 400, the player is enabled to adjust the information presented in the scorekeeping row 410*b*. The right and left keys 404*b* and 404*c* enable a user to toggle between the scores presented on the display 402 (e.g., between Team 1 points, Team 2 points, Team 1 games won, Team 2 games won, and server number). A pointer may be presented on the screen that moves as the player toggles between the scores using the keys 404*b* and 404*c*. The player may use the up and down keys 404*a* and 404*d* to increase or decrease, respectively, the score presented on the display that is toggled to by the player (as indicated by the pointer). In the example shown in FIG. 4, the display 402 has been controlled to indicate a pickleball score in which Team 1 has three points, Team 2 has 1 point, Team 1 has won 1 games, Team 2 has won 2 games, and the server number on the serving team is 1. The pointer is on the Team 1 points score, indicating to the player that pressing the up and down keys 404*a* and 404*d* will increase and decrease, respectively, the Team 1 points score presented on the display 402.

Figure 7:
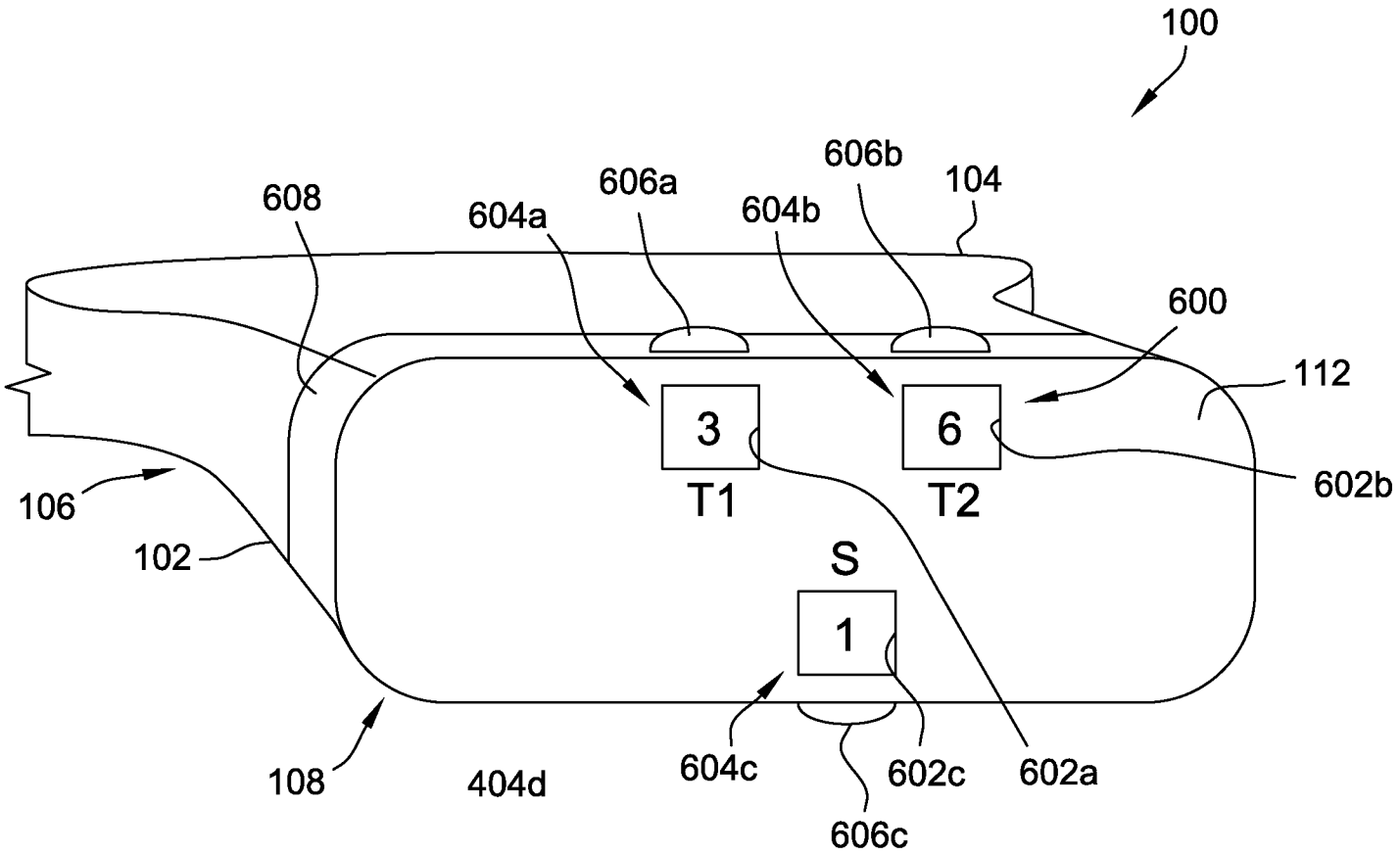
FIG. 7 is a bottom view of the paddle shown in FIG. 1 showing a third alternative embodiment of a scorekeeping device installed in the paddle.

Referring now to FIG. 7, a bottom view of the paddle 100 is shown to depict the proximal handle end 108, the butt cap 112, and yet another example scorekeeping device 600 in greater detail. Like the scorekeeping devices 200, 300, and 400 described above, the example scorekeeping device 600 may suitably be implemented as the scorekeeping device 126 (shown in FIG. 1). The scorekeeping device 600 in this example includes mechanical dials 604*a* and 604*b* that are manipulable by a user of the paddle 100 for a scorekeeping operation. The dials 604*a* and 604*b* are each rotary dials that contain an array of numbers of suitable length for scorekeeping (e.g., 0-9, 0-21, etc.).

A number contained on the first dial 604*a* is viewable via a first opening 602*a* in the butt cap 112 and a number contained on the second dial 604*b* is viewable via a second opening 602*b* in the butt cap 112. Each dial 604*a* and 604*b* has an outer portion 606*a* and 606*b*, respectively, that extends outwardly from a peripheral edge 608 of the butt cap 112. The outer portions 606*a* and 606*b* of the respective dials 604*a* and 604*b* are accessible to the user of the paddle 100 and enable the user to manipulate the dials 604*a* and 604*b* to change the number contained on the dials 604*a* and 604*b* that is viewed through the respective opening 602*a* and 602*b*. In the example shown, the user may rotate each dial 604*a* and 604*b* in a clockwise direction, relative to the orientation shown in FIG. 7, to increase, incrementally, the number viewed through the respective opening 602*a* and 602*b*. Similarly, the user may rotate each dial 604*a* and 604*b* in a counter-clockwise direction, relative to the orientation shown in FIG. 7, to decrease, incrementally, the number viewed through the respective opening 602*a* and 602*b*. In other examples, the direction at which the dials 604*a* and 604*b* are rotated may vary depending, for example, on the configuration of the dials 604*a* and 604*b* (e.g., the order in which the array of numbers are contained in the dials 604*a* and 604*b*), and the relative locations of the dials 604*a* and 604*b* in the scorekeeping device 600. The first and second dials 604*a* and 604*b* may be designated for tracking the points scored by Team 1 and Team 2, respectively. The scorekeeping device 600 may also include a third dial 604*c* viewable through a third opening 602*c*, and may be designated for tracking the server number. The third dial 604*c* may contain an array of numbers of a suitable length for this function (e.g., 1-2). An outer portion 606*c* of the third dial 604*c* extends outwardly from the peripheral edge 608 of the butt cap 112 and enables a user to manipulate the dial 604*c* and change the number viewed through the opening 602*c* as described above for the dials 604*a* and 604*b*. The butt cap 112 may include insignia that indicate the scorekeeping functions of each dial 604*a*-604*c*.

Figure 8:
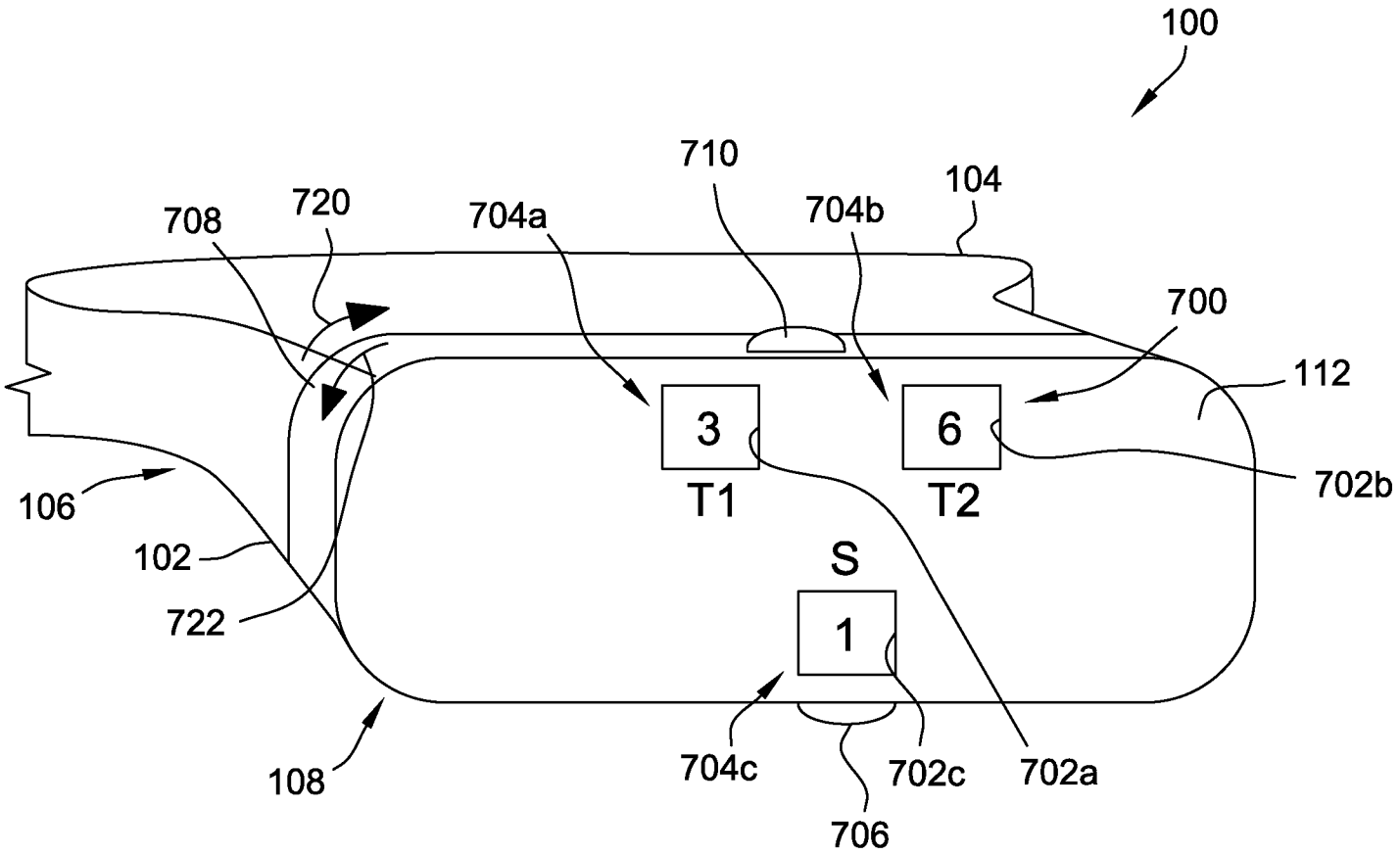
FIG. 8 is a bottom view of the paddle shown in FIG. 1 showing a fourth alternative embodiment of a scorekeeping device installed in the paddle.

Referring now to FIG. 8, a bottom view of the paddle 100 is shown to depict the proximal handle end 108, the butt cap 112, and yet another example scorekeeping device 700 in greater detail. The scorekeeping device 700 is similar to the scorekeeping device 600 shown in FIG. 7, and may suitably be implemented as the scorekeeping device 126 (shown in FIG. 1). Like the dials 604*a*-604*c* of the scorekeeping device 600, the scorekeeping device 700 in this example includes dials 704*a*-704*c* that are manipulable by a user of the paddle 100 for a scorekeeping operation and contain an array of numbers of suitable length for the respective scorekeeping function (e.g., 1-2, 0-9, 0-21, etc.). A number contained on each dial 704*a*-704*c* is viewable through a respective opening 702*a*-702*c*.

In the example scorekeeping device 700, the dials 704*a* and 704*b*, which are designated for tracking the points scored by Team 1 and Team 2, respectively, are manipulable by a user turning the butt cap 112 in a clockwise or counter-clockwise direction. That is, the butt cap 112 is rotatable, relative to the handle 102, to cause the dials 704*a* and 704*b* to rotate and change the number viewed through the respective opening 702*a* and 702*b*. Rotation of the butt cap 112 (indicated by the arrows 720 and 722) may only cause one of the dials 704*a* and 704*b* to rotate. A switch 710 is provided that extends outwardly from the butt cap 112 (e.g., from a peripheral edge 708 of the butt cap in the illustrated example). The switch 710 enables the user to select which of the dials 704*a* and 704*b* rotates with rotation 720, 722 of the butt cap 112. Thus, in operation, the user moves the switch to the position corresponding to the dial 704*a* or 704*b* that the user desires to manipulate, and the user rotates the butt cap 112 in a suitable direction to increment or decrement the number viewed through the respective opening 702*a* or 702*b*. For example, rotating the butt cap 112 in a clockwise direction 720 may increase, incrementally, the number viewed through the respective opening 702*a* and 702*b*, and rotating the butt cap 112 a counter-clockwise direction 722 may decrease, incrementally, the number viewed through the respective opening 702*a* and 702*b*. In other examples, the direction at which the butt cap 112 is rotated to increment or decrement the number viewed through the openings 702*a* or 702*b* may be reversed. The third dial 704*c* is designated for tracking the server number and, like the third dial 604*c* of the scorekeeping device 600, the third dial 704*c* includes an outer portion 706 that extends outwardly from the peripheral edge 708 of the butt cap 112 and enables a user to manipulate the dial 704*c* and change the number viewed through the opening 702*c*. The butt cap 112 may include insignia that indicate the scorekeeping functions of each dial 704*a*-704*c* as well as the position of the switch 710 that corresponds to the dial 704*a* and 704*b* that rotates with the butt cap 112.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A paddle for use in a racket sports game, the paddle comprising:

a head;

a handle extending from the head between a distal handle end proximate the head and an opposite proximal handle end;

a butt cap installed in the paddle at the proximal handle end, the butt cap including a housing portion including a first face defining an opening extending through the first face; and a scorekeeping device installed in the paddle adjacent to the proximal handle end, the scorekeeping device being housed in the housing portion and configured to display score keeping information through the opening in the first face.

2. The paddle of claim 1, wherein the scorekeeping device is removably installed in the paddle, and wherein the housing portion is sized and shaped to complement a size and shape of the handle at the proximal handle end.

3. The paddle of claim 2, wherein the butt cap further comprises a sleeve extending from the housing portion that receives the proximal handle end to removably install the butt cap in the paddle, the sleeve extending from a first sleeve end that attached to the housing portion to a second sleeve end positioned outwardly from a second opposed face of the housing portion, and wherein an additional opening is defined at the second sleeve end that receives the proximal handle end of the handle.

4. The paddle of claim 1, wherein the scorekeeping device includes a set of dials that each contain an array of numbers, each of the dials being manipulable by a user of the paddle for a scorekeeping operation.

5. The paddle of claim 4, wherein the opening defines a viewable matrix for the dials, and wherein the dials are accessible to the user via the butt cap opening for manipulating the dials.

6. The paddle of claim 4, wherein the opening defines a viewable matrix for the dials, wherein the scorekeeping device further includes a set of gears, each of the gears being operably connected to one of the dials to enable the user to manipulate the dials using the gears.

7. The paddle of claim 4, wherein the set of dials includes five dials.

8. The paddle of claim 1, wherein the scorekeeping device is electronically powered and includes a display configured to present scorekeeping information and keys in communication with the display that enable a user of the paddle to adjust the scorekeeping information presented on the display.

9. A paddle for use in a pickleball game, the paddle comprising:

a head;

faceplates attached to the head, the faceplates defining opposing surfaces of the head for striking a pickleball ball;

a handle extending from the head between a distal handle end proximate the head and an opposite proximal handle end;

a butt cap installed in the paddle at the proximal handle end, the butt cap including a housing portion including a first face defining an opening extending through the first face; and a scorekeeping device installed in the paddle adjacent to the proximal handle end, the scorekeeping device being housed in the housing portion and configured to display score keeping information through the opening in the first face.

10. The paddle of claim 9, wherein the butt cap further comprises a sleeve extending from the housing portion that receives the proximal handle end to removably install the butt cap in the paddle.

11. The paddle of claim 9, wherein the scorekeeping device includes a set of dials that each contain an array of numbers, each of the dials being manipulable by a user of the paddle for a scorekeeping operation.

12. The paddle of claim 11, wherein the opening defines a viewable matrix for the dials, wherein the dials are accessible to the user via the butt cap opening for manipulating the dials.

13. The paddle of claim 11, wherein the opening defines a viewable matrix for the dials, wherein the scorekeeping device further includes a set of gears, each of the gears being operably connected to one of the dials to enable the user to manipulate the dials using the gears.

14. The paddle of claim 11, wherein the set of dials includes five dials.

15. The paddle of claim 9, wherein the scorekeeping device is electronically powered and includes a display configured to present scorekeeping information and keys in communication with the display that enable a user of the paddle to adjust the scorekeeping information presented on the display.

16. A scorekeeping assembly for a sports paddle that includes a handle, the scorekeeping assembly comprising:

a scorekeeping device for presenting scorekeeping information to a user; and a butt cap connectable with an end of the handle, the butt cap including a housing portion that houses the scorekeeping device, wherein the butt cap includes a sleeve extending from the housing portion that is sized and shaped to receive at least a portion of the end of the handle and removably connect the butt cap with the end of the handle, the housing portion including a first face defining an opening extending through the first face, the scorekeeping device being configured to present the scorekeeping information through the opening in the first face.

17. The scorekeeping assembly of claim 16, wherein the scorekeeping device includes a set of dials that each contain an array of numbers, each of the dials being manipulable by a user of the paddle for a scorekeeping operation, and wherein the housing portion of the butt cap includes a butt cap opening that defines a viewable matrix for the dials.

18. The paddle of claim 1, wherein the housing portion of the butt cap includes a second face positioned opposite the first face and in contact with the proximal handle end, a peripheral edge joining the first face and the second face, and a sleeve attached to the peripheral edge and extending outward from the second face to an additional opening for receiving the handle therein.

19. The paddle of claim 18, wherein the sleeve is coupled to the handle in a friction fit, and wherein the sleeve includes at least one of rubber, leather, plastic, and a synthetic polymer material.

* * * * *